US007670110B2

(12) United States Patent
Erler et al.

(10) Patent No.: US 7,670,110 B2
(45) Date of Patent: Mar. 2, 2010

(54) SIDELOAD VANES FOR FLUID PUMP

(75) Inventors: Scott R. Erler, Wellington, FL (US); Michael H. Dills, West Hartford, CT (US); Jose L. Rodriguez, Heathrow, FL (US); John Eric Tepool, Owens Cross Roads, AL (US)

(73) Assignee: United Technologies Corporation, Hartford, CT (US)

( * ) Notice: Subject to any disclaimer, the term of this patent is extended or adjusted under 35 U.S.C. 154(b) by 817 days.

(21) Appl. No.: 11/485,830

(22) Filed: Jul. 13, 2006

(65) Prior Publication Data

US 2008/0014081 A1 Jan. 17, 2008

(51) Int. Cl.
*F04D 17/12* (2006.01)

(52) U.S. Cl. ..... 415/195; 415/198.1

(58) Field of Classification Search ..... 416/203; 415/172.1, 224, 198.1, 195, 104
See application file for complete search history.

(56) References Cited

U.S. PATENT DOCUMENTS

| | | | | |
|---|---|---|---|---|
| 4,983,051 | A | 1/1991 | Hibner et al. | |
| 5,320,482 | A * | 6/1994 | Palmer et al. | 415/104 |
| 5,605,434 | A * | 2/1997 | Haag et al. | 415/106 |
| 6,053,636 | A | 4/2000 | Pelfrey et al. | |

FOREIGN PATENT DOCUMENTS

CH 655357 A * 4/1986

* cited by examiner

*Primary Examiner*—Richard Edgar
(74) *Attorney, Agent, or Firm*—Kinney & Lange, P.A.

(57) ABSTRACT

A fluid pump assembly includes a rotatable component that can be rotated about an axis and a static vane assembly located adjacent to the rotatable component. The static vane assembly includes a circumferential surface axially spaced from the rotatable component, and one or more vanes extending from the circumferential surface toward the rotatable component. The one or more vanes are configured to produce a radial load on the rotatable component when the rotatable component is rotating about the axis and a fluid is present between the static vane assembly and the rotatable component.

19 Claims, 5 Drawing Sheets

SIDELOAD VANES FOR FLUID PUMP

STATEMENT OF GOVERNMENT INTEREST

The present invention was made, in part, with government funding under NASA Contract No. NAS8-36801. The U.S. Government has certain rights in this invention.

BACKGROUND OF THE INVENTION

The present invention relates to vane assemblies suitable for use in fluid pumps, and more particularly to static vane assemblies for producing radial loads on turbopump components.

Rocket engines can utilize turbopumps to deliver propellants to an injector assembly in the combustion chamber. Such turbopumps have rotors that rotate as the turbopump operates, and impellers that rotate as part of the rotor to increase the pressure of propellants or propellant mixtures. It is desired to obtain a low, steady synchronous vibration response during turbopump operation. However, for a variety of reasons, a particular turbopump may produce an undesired sub-synchronous response. Sub-synchronous vibration responses can be caused, at least in part, by insufficient radial loading on a given bearing set of the turbopump.

Undesired asynchronous vibration response issues could be addressed in a number of ways. However, many potential solutions are overly complex, insufficiently robust, or are otherwise undesirable, for instance, resulting in an unsatisfactory turbopump performance loss. As one example, the rotor bearings could be redesigned, but redesigns of rotor bearings are difficult and complex. Moreover, flow inlets and outlets create load vectors that could be optimized relative to undesired vibrations, but optimal inlet and outlet flow paths may undesirably increase engine size and/or mass and may provide optimal design "windows" (i.e., tolerances on desired vibration characteristics) that are too small to be practical.

BRIEF SUMMARY OF THE INVENTION

A turbopump assembly according to the present invention includes a rotatable component that can be rotated about an axis and a static vane assembly located adjacent to the rotatable component. The static vane assembly includes a circumferential surface axially spaced from the rotatable component, and one or more vanes extending from the circumferential surface toward the rotatable component. The one or more vanes are configured to produce a radial load on the rotatable component when the rotatable component is rotating about the axis and a fluid is present between the static vane assembly and the rotatable component.

DETAILED DESCRIPTION

The present invention provides an apparatus and method for reducing undesired vibration of components of a fluid pump. In particular, the present invention provides advantages in producing radial loading on bearing supports for pump rotors, which otherwise permit undesired vibrations in an unloaded condition. The present invention utilizes sideload vanes positioned adjacent to rotating members that work upon the fluid in the pump. The sideload vanes produce a non-uniform circumferential pressure field in a fluid in the pump, as fluid moves in a flowpath adjacent to the vanes. The non-uniform circumferential pressure field in turn, imparts radial loading to rotor bearings that otherwise would be substantially unloaded and prone to undesirable vibration issues.

Figure 1:
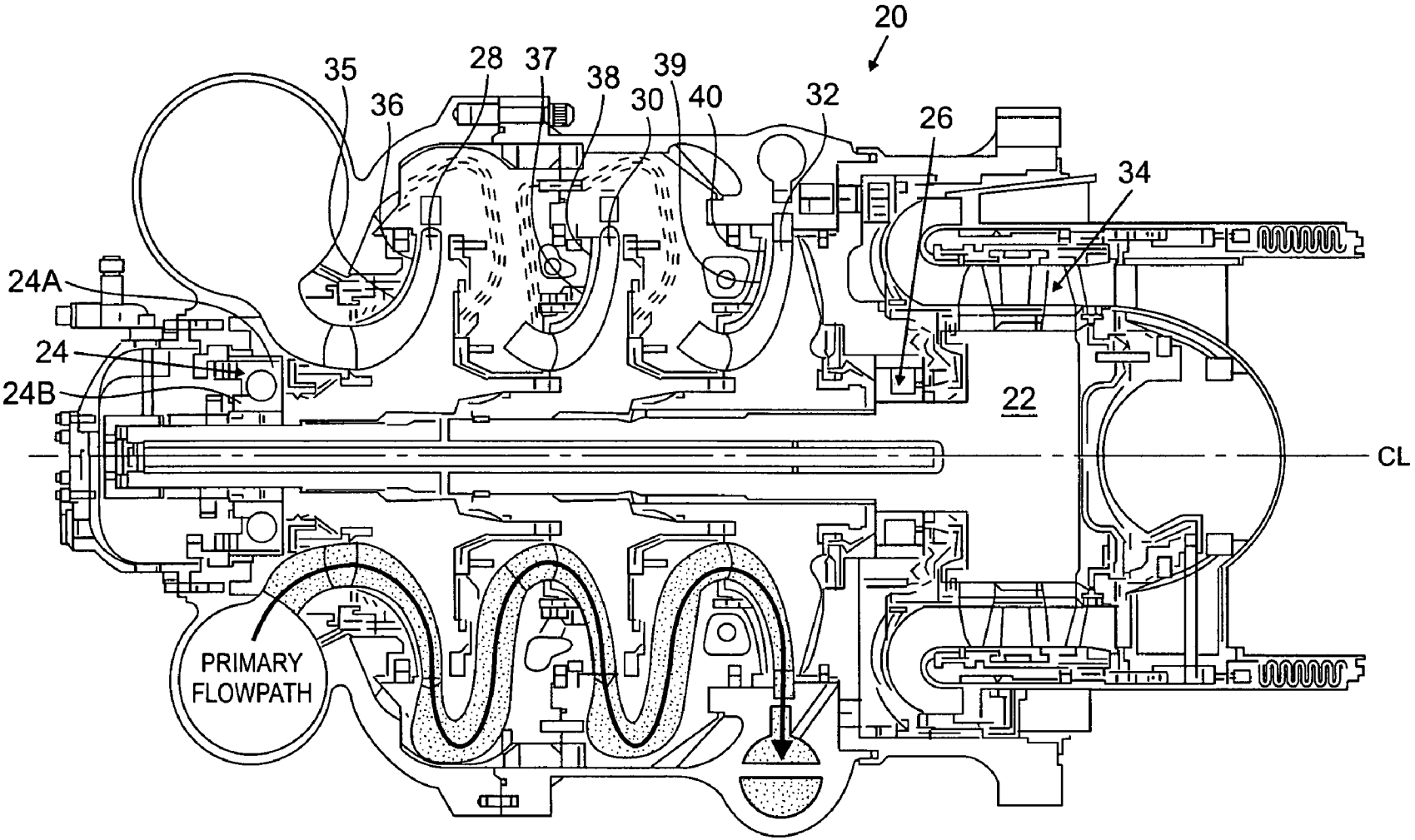
FIG. 1 is a schematic cross-sectional view of a turbopump.

FIG. 1 is a schematic cross-sectional view of a turbopump 20 that includes a rotor shaft 22 located at a centerline CL, a first bearing set 24, a second bearing set 26, and three impellers 28, 30, 32 (referred to as the first through third stage impellers, respectively). A turbine assembly 34 is mechanically connected to the rotor shaft 22. The first bearing set 24 is a ball bearing set that includes an outer race 24A and an inner race 24B. The inner race 24B rotates with the rotor shaft 22, while the outer race 24A is static. As used herein, the term "static" refers to being stationary relative to a pump mounting location, and applies even where the entire pump or turbopump has a mounting location in a moving vehicle (or on another movable object). The second bearing set 26 is a roller bearing set. The first and second bearing sets 24 and 26 support the rotating components of the turbopump 20 (see FIG. 5) relative to the static components of the turbopump 20. The impellers 28, 30, 32 and the rotor shaft 22 are rotating components when the turbopump 20 is operational. The impellers 28, 30, 32 all rotate together with the rotor shaft 22, which is driven by rotation of the turbine assembly 34. In operation, a fluid is pumped sequentially through the impellers 28, 30, 32, which move and pressurize the fluid. The impellers 28, 30, 32 generally move the fluid through the turbopump 20 along a primary flowpath, a portion of which is indicated schematically in FIG. 1. Those skilled in the art will recognize that the primary flowpath has a complex shape defined by the rotating impellers 28, 30, 32 and connecting passageways.

A sideload portion 35 of a first diffuser 36 is located adjacent to the first impeller 28, a sideload portion 37 of a second diffuser 38 (also called the 1-2 diffuser) is located adjacent to the second impeller 30, and a sideload portion 39 of a third diffuser 40 (also called the 2-3 diffuser) is located adjacent to the third impeller 32. The diffusers 36, 38, 40 are static components located at a forward or upstream side of the respective adjacent impellers 28, 30, 32 (to the left of the impellers 28, 30, 32 as shown in FIG. 1). A portion of a secondary flowpath is defined in a gap between the sideload portions of the diffusers and the adjacent impellers, for instance, between the sideload portion 37 of the second diffuser 38 and the second impeller 30. The secondary flowpath corresponds to a fluid flow that is generally outside the primary flowpath that carries the majority of fluid through the turbopump 20. In a conventional prior art turbopump, the secondary flowpaths between the sideload portions 35, 37, 39 of each of the diffusers 36, 38, 40 and the impellers 28, 30, 32 would be circumferentially uniform, a condition which would produce no net radial load on the rotor shaft 22 or first bearing set 24.

The turbopump 20 includes numerous other components not specifically identified herein. Those skilled in the art will understand the basic operation of turbopumps. Therefore, further explanation here is unnecessary.

Figure 2:
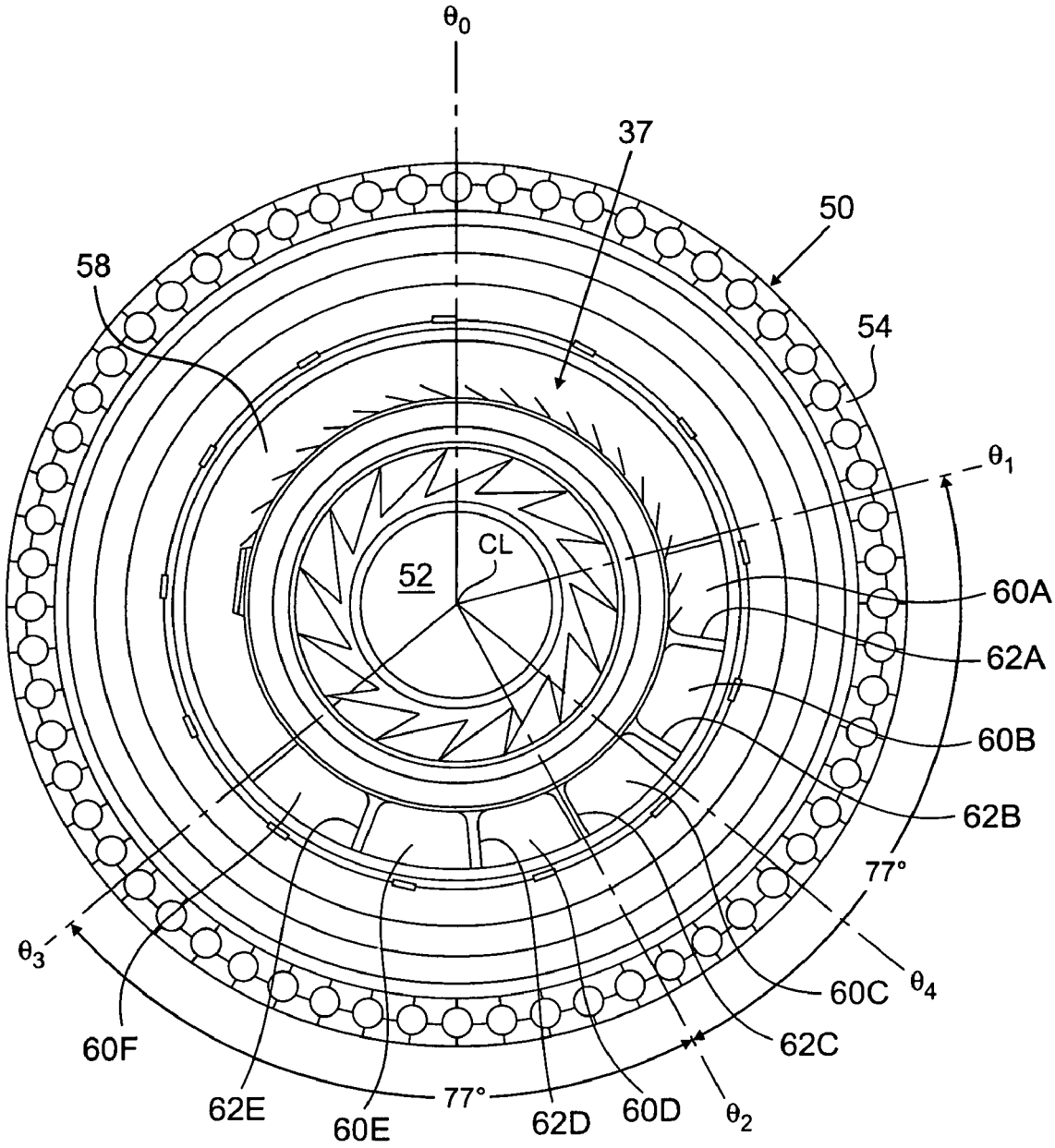
FIG. 2 is front view of a sideload vane assembly according to the present invention.
Figure 3:
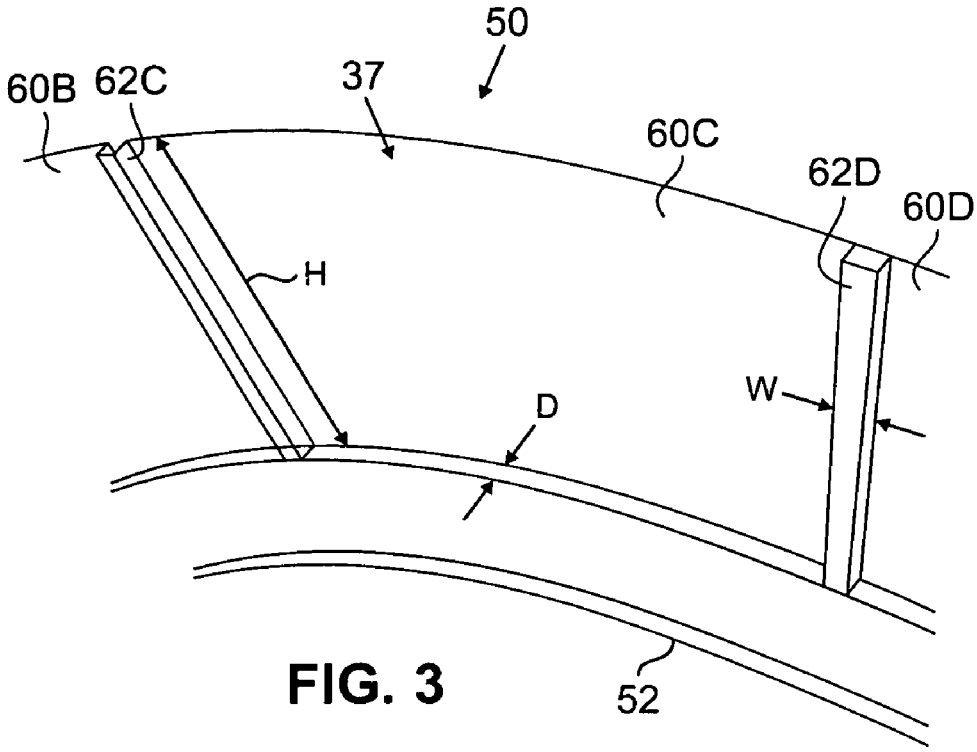
FIG. 3 is a perspective view of a portion of the sideload vane assembly of FIG. 2.

FIGS. 2 and 3 illustrate one embodiment of a sideload vane assembly 50, which is positioned at the second diffuser 38 (see FIG. 1). It should be recognized that the sideload vane assembly 50 could be positioned adjacent to any of the impellers 28, 30, 32 of the turbopump 20 in alternative embodiments. FIG. 2 is front (axial) view of the sideload vane assembly 50 (viewed from the second impeller 30 toward the first impeller 28), and FIG. 3 is a perspective view of a portion of the sideload vane assembly 50 shown in FIG. 2. Reference markers for angles $\Theta_0$-$\Theta_3$ are shown in FIG. 2 in order to better explain angular positioning of various features about the centerline CL.

The sideload vane assembly 50 is a static component that includes a central opening 52 for the rotor shaft 22 and flange 54 at the perimeter of the assembly having bolt holes for mounting the assembly 50 in the turbopump 20. The assembly 50 can be made of a metallic material, such as aluminum. A sideload wall 37 is positioned (radially) between the central opening 52 and the flange 54. The sideload wall 37 extends circumferentially about the entire assembly 50, that is, the sideload wall 37 has an angular sweep of 360° about the centerline CL. The sideload wall 37 is radially positioned so as to align with one of the side of the diffusers 36, 38 or 40 adjacent to one of the corresponding impellers 28, 30 or 32.

The sideload wall 37 includes a substantially smooth wall portion 58 and six pockets 60A-60F. The pockets 60A-60F form five vanes 62A-62E at the circumferentially spaced edges thereof. As shown in FIG. 2, the vanes 62A-62E are located within a first angular region, which has an angular sweep of 154° about the centerline CL between angles $\Theta_1$ and $\Theta_3$. The vanes 62A-62E are substantially equally angularly spaced within the first angular region. The substantially smooth wall portion 58 is located within a second angular region, which has an angular sweep of 205° about the centerline CL between angles $\Theta_3$ and $\Theta_1$. The first and second angular regions have a combined angular sweep of 360°, that is, together they extend circumferentially about the entire assembly 50. It should be noted that in alternative embodiments, the number and arrangement of the vanes can vary. For example, more or fewer than six pockets can be formed. Moreover, the first angular region can have a greater or lesser angular sweep, and the position of the first angular region (i.e., the "rotational" position of the reference markers with respect to a pump mounting location) can vary. Furthermore, the vanes need not be equally angularly spaced.

In FIG. 3, a portion of the sideload wall 37 is shown, including pockets 60B-60D and vanes 62C-62D. A number of reference dimensions are indicated in FIG. 3, including a vane height H, a vane width W, and a pocket depth D. The dimensions H, W, and D can be adjusted for particular applications, to provide desired performance characteristics, including desired radial loading.

Each of the vanes 62A-62E has a substantially rectangular shape, and the pockets 60A-60F and vanes 62A-62E can be formed by milling the sideload wall 37. Use of rectangular vanes simplifies manufacture while still providing sufficient structural integrity. In alternative embodiments, the shape of the vanes can vary as desired.

In operation, as fluid is being pumped through the turbopump 20, the sideload vane assembly 50 interacts with the fluid in the secondary flowpath (i.e., in the gap between the sideload vane assembly 50 and the adjacent second impeller 30). The vanes 62A-62E of the assembly 50 act like asymmetric swirl brakes and generate a non-uniform circumferential pressure field in fluid in the secondary flowpath. The non-uniform circumferential pressure field imparts a moment on the adjacent second impeller 30, and that moment produces a radial force component in the second impeller 30 that, in turn, radially loads the rotor shaft 22 and the first bearing set 24.

Figure 4:
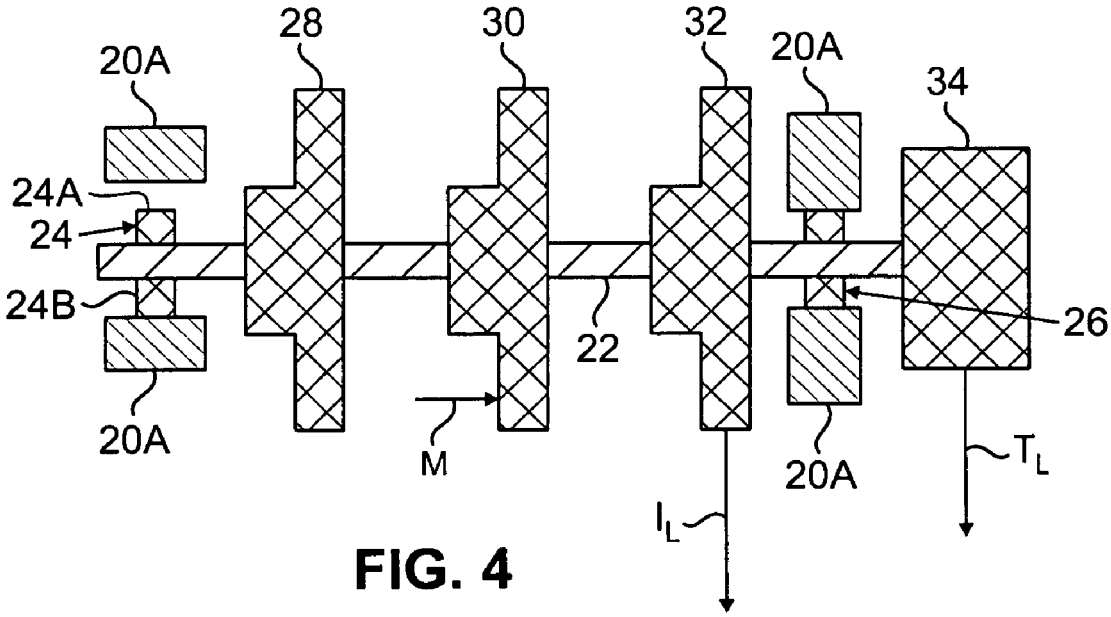
FIG. 4 is a simplified schematic cross-sectional view of a portion of the turbopump of FIG. 1 that is radially loaded.

FIG. 4 is a simplified schematic cross-sectional view of a portion of the turbopump 20, showing a net moment M on the second impeller 30 due to a non-uniform circumferential pressure field generated in conjunction with an adjacent sideload vane assembly 50 (not shown). The moment M is shown in FIG. 4 with a generally axial orientation at a location radially spaced from the rotor shaft 22 (and its centerline CL). The magnitude and location of the moment M will vary according to the characteristics of particular applications. As explained below, the moment M, in turn, produces radial loading in a first direction (at an angle $\Theta_4$, not shown) on the rotor shaft 22 and the first bearing set 24 (and/or the second bearing set 26) as force is transmitted through the impeller 30 and the rotor shaft 22. As shown in FIG. 4, the second bearing set 26 acts like as a fulcrum, while the first bearing set 24 has some freedom of radial movement with respect to a pump housing or ground 20A. This is because the configuration of the turbopump 20 provides sufficient stiffness to the second bearing set 26 to keep it engaged. It should be recognized that the particular characteristics of the bearing sets 24 and 26 will vary depending on the particular configuration of the turbopump 20 and its housing 20A.

A vector $I_L$ represents natural radial loading of the third impeller 32, and a vector $T_L$ represents natural radial loading of the turbine assembly 34. Vector $I_L$ is oriented at about 0-50° with respect to a given angular reference point $\Theta_5$ (not shown), and vector $T_L$ is oriented at about 0° with respect to the reference point $\Theta_5$. The vectors $I_L$ and $T_L$ arise due to the rotation of and interaction with fluids by the third impeller 32 and the turbine assembly 34, and due to configurations of fluid inlets and outlets of the turbopump 20. Vectors $I_L$ and $T_L$ establish a preferred direction of radial loading for the turbopump 20, based on the natural characteristics of the turbopump 20, that is, based on factors substantially independent from radial loading imparted by the sideload vane assembly 50. The vectors $I_L$ and $T_L$ generally have small magnitudes that, alone, do not provide significant stiffness to the first bearing set 24.

The sideload vane assembly 50 is configured such that the first direction of radial loading imparted by assembly 50 substantially aligns with the preferred direction of radial loading of the turbopump 20 (i.e., such that $\Theta_4 \approx \Theta_5$). Such alignment, although not strictly necessary, improves the effectiveness of the radial loading and reduces performance losses.

Figure 5:
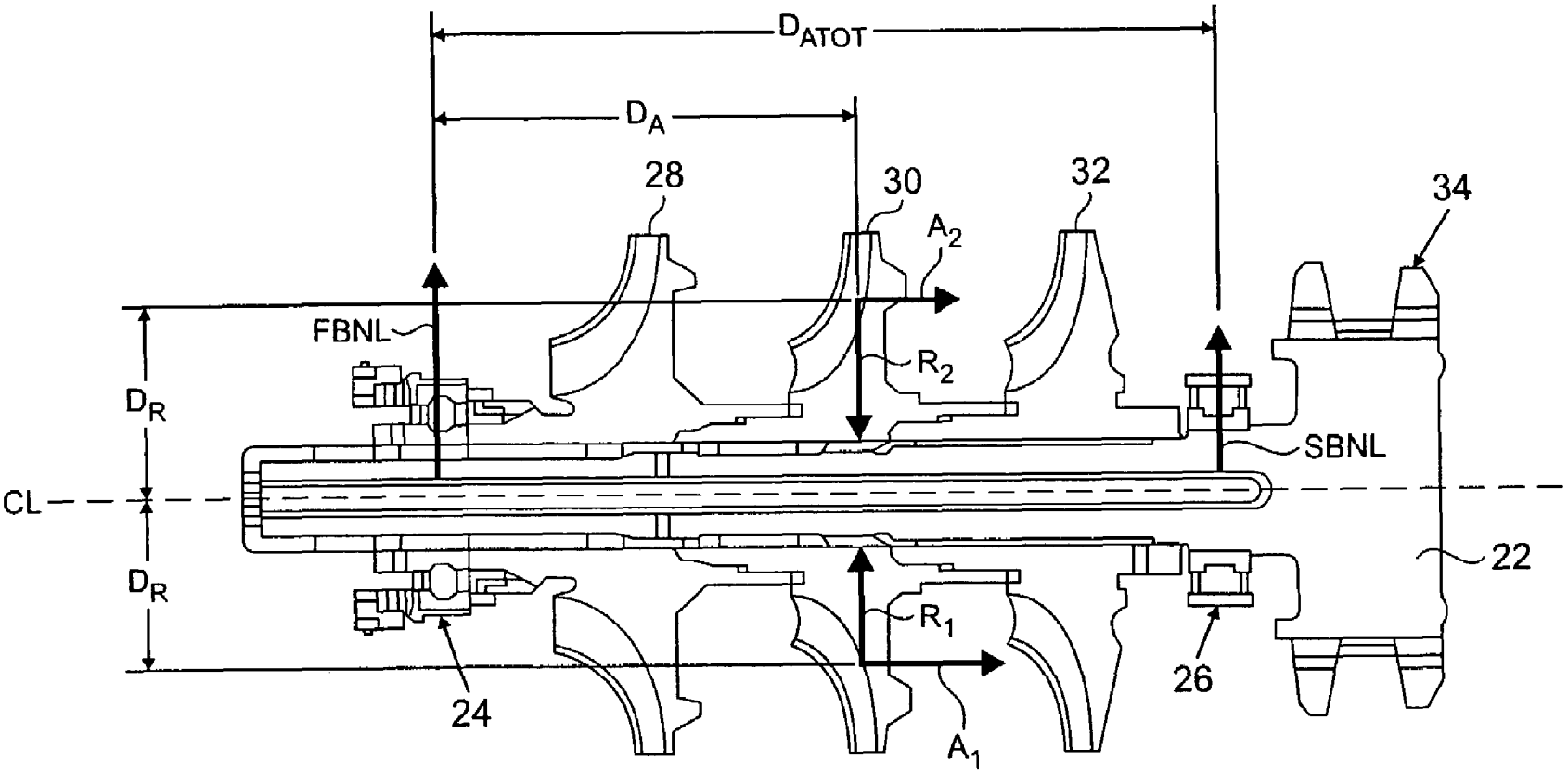
FIG. 5 is a schematic cross-sectional view of a portion of the turbopump of FIG. 1.

FIG. 5 is a free body diagram of the rotatable components of the turbopump 20, showing the impellers 28, 30, 32, the shaft 22, and a portion of the turbine assembly 34 in a schematic cross-sectional form. A number of reference markings for vectors, distances, etc. are indicated in FIG. 5 to illustrate some of the parameters that influence loading on components of the turbopump 20 during operation. The definitions of these reference markings are given in Table 1.

TABLE 1

| Reference Marking | Definition |
|---|---|
| $A_1$ | Vector for axial load on the selected impeller associated with the first angular region (of the adjacent sideload vane assembly) |

TABLE 1-continued

| Reference Marking | Definition |
|---|---|
| $A_2$ | Vector for axial load on the selected impeller associated with the second angular region (of the adjacent sideload vane assembly) |
| CL | Turbopump centerline axis aligned at the center of the rotor shaft |
| $D_A$ | Axial distance between the selected impeller and the first bearing set (measured midpoint-to-midpoint) |
| $D_{ATOT}$ | Axial distance between the first bearing set and the second bearing set (measured midpoint-to-midpoint) |
| $D_R$ | Radial distance between the selected impeller and CL (measured midpoint to midpoint) |
| $R_1$ | Vector for radial load on the selected impeller at the first angular region |
| $R_2$ | Vector for radial load on the selected impeller at the second angular region, with vector $R_2$ being positioned 180° from vector $R_1$ |
| FBNL | Vector for the net radial load on the first bearing set |
| SBNL | Vector for the net radial load on the second bearing set |

It should be noted that although reference markings are shown in FIG. 5 primarily with respect to the second impeller 30, similar parameters would exist for the other impellers 28, 32 where sideload vane assemblies were located adjacent to the other impellers 28, 32.

The magnitude for the vector FBNL (i.e., the net radial load on the first bearing set 24) is given by the following equation:

$$FBNL = \left(1 - \frac{D_A}{D_{ATOT}}\right)R_1 + \left(\frac{D_A}{D_{ATOT}} - 1\right)R_2 + (A_2 - A_1)\frac{D_R}{D_{ATOT}} \quad (1)$$

The vector FBNL for the sideload vane assembly 50 of FIG. 2 is directed at an angle designated as $\Theta_4$, which can be determined empirically. The angle $\Theta_4$ generally lies within the first angular region of the vane assembly 50, and is generally offset from the symmetry line of the first angular region (i.e., angle $\Theta_2$) in a direction opposite to the direction of rotation of the impellers 28, 30, 32 and rotor shaft 22. The offset of angle $\Theta_4$ from angle $\Theta_2$ is due to the fluid dynamics within the pump.

The magnitude for the vector SBNL (i.e., the net radial load on the second bearing set 26) is given by the following equation:

$$SBNL = \frac{D_R}{D_{ATOT}}(A_1 - A_2) + \frac{D_A}{D_{ATOT}}(R_1 - R_2) \quad (2)$$

The vector FBNL gives the anticipated radial loading on the first bearing set 24, and the sideload vane assembly 50 can be configured such that the anticipated radial loading provides desired stiffness to maintain engagement of the first bearing set 24 (e.g., to maintain engagement of the first bearing set 24 with the housing 24A). Equations (1) and (2), and the free body diagram in FIG. 5 help illustrate the relationship of the forces that produce radial loading on the first bearing set 24 due to the non-uniform circumferential pressure field created by the sideload vane assembly 50.

EXAMPLE

A bench test experiment was performed on an embodiment of the vane assembly 50 like that described above. The turbopump 20 was run under normal operating conditions pumping water. The sideload vane assembly 50 had five vanes 62A-62E and six pockets 60A-60F, where the vane length L was 3.429 cm (1.35 inches), the vane width W was 0.635 cm (0.250 inches), the pocket depth D was 0.1524 cm (0.060 inches). The vanes 62A-62E were equally circumferentially spaced within a first angular region having an angular sweep of about 154°.

Figure 6:
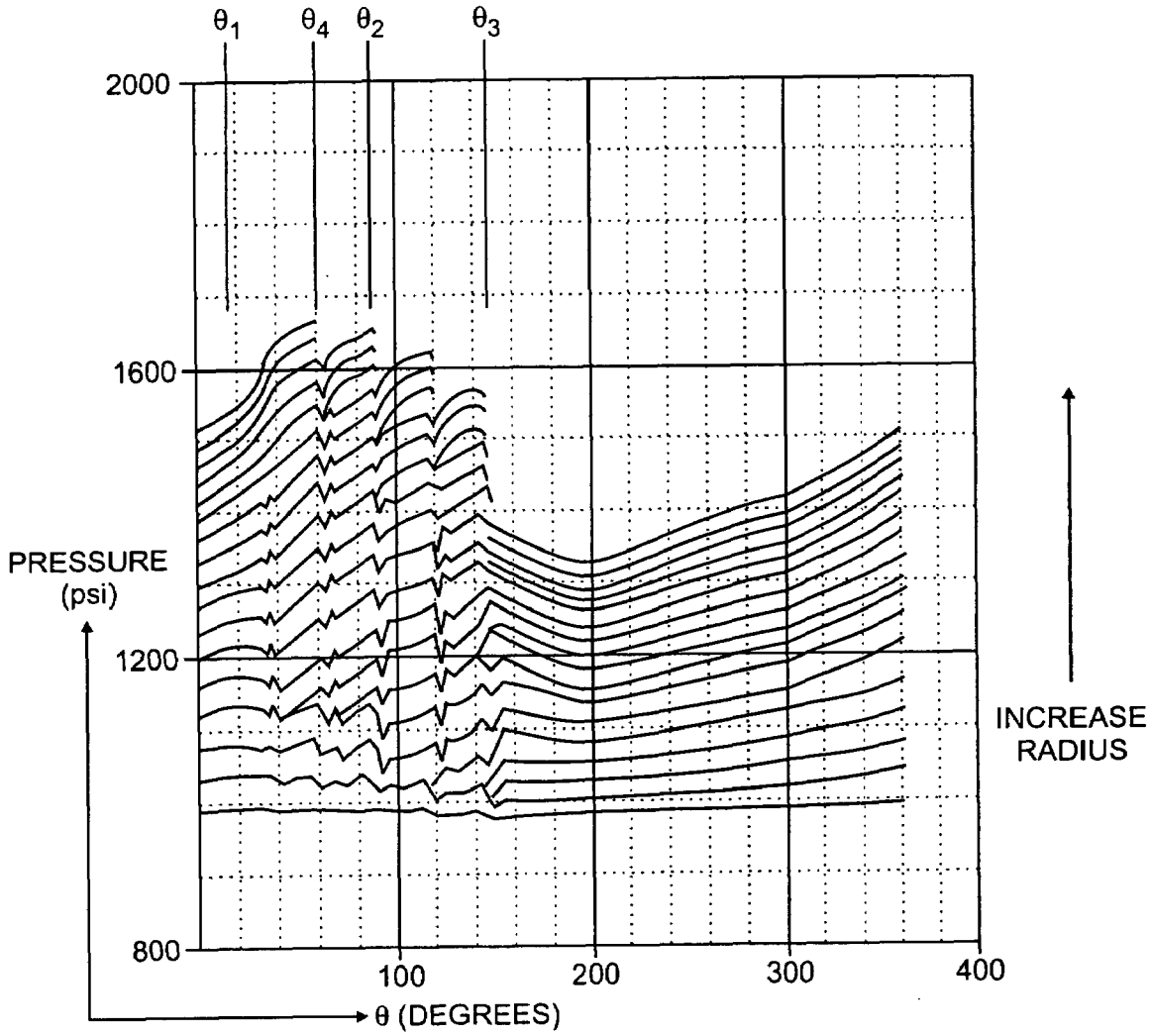
FIG. 6 is a graph of fluid pressure versus angular location calculated for a number of radial locations in a secondary flowpath of a turbopump.

FIG. 6 is a graph of fluid pressure versus angular location calculated for a number of radial locations in the secondary flowpath of the turbopump 20. On the X-axis, Θ represents the angular location about the turbopump centerline CL in degrees (measured 0-360° from an arbitrarily selected reference point). On the Y-axis, pressure in pounds per square inch (psi) represents the measured static fluid pressure. A number of plots are shown on the graph of FIG. 6 each based on pressures at different radial locations from the centerline CL (with the greater radii corresponding to greater average pressures in the fluid).

The first angular region of the sideload vane assembly 50 corresponds approximately to values of Θ between $\Theta_1$ and $\Theta_3$ (inclusive of $\Theta_2$), as shown in the graph of FIG. 6. The second angular region of the sideload vane assembly 50 corresponds roughly to values of Θ between $\Theta_1$ and $\Theta_3$ (exclusive of $\Theta_2$) on the graph. The graph shows acute pressure rises that generally correspond to when the fluid passed each of the vanes 62A-62E in the first angular region, with the pressure rise being greatest at locations further from the centerline CL. At the smallest radii, nearest the centerline CL, the effects of the vanes 62A-62E is less pronounced. However, because of radial fluid movement during operation of the turbopump 20, causing fluid to move away from the vanes 62A-62E, the number of acute rises in fluid pressure did not strictly correspond to the number of vanes (five). The angle of radial loading $\Theta_4$ in the present example was approximately 60° with respect to the arbitrarily selected reference point shown on FIG. 6. $\Theta_4$ can be calculated according to the following equation, where P is the pressure, r is a variable for the radial location and Θ is the variable in the horizontal axis of FIG. 6:

$$\Theta_4 = \frac{\int P * \Theta * d\Theta * dr}{\int \Theta * d\Theta * dr} \quad (3)$$

The magnitude of FBNL (i.e., the net radial load on the first bearing set 24) was 185.519 kg (409 lbs.), and that value was obtained by integrating the area under the plots of the graph of FIG. 6.

Although the present invention has been described with reference to preferred embodiments, workers skilled in the art will recognize that changes may be made in form and detail without departing from the spirit and scope of the invention. For instance, a sideload vane assembly according to the present invention can have a variety of vane and pocket configurations. Moreover, a fluid pump can utilize one or more sideload vane assemblies according to the present invention in a variety of locations. In addition, sideload vane assemblies according to the present invention can be used to reduce the net radial loads on components (e.g., bearings) of a fluid pump, as desired, by configuring the sideload vane assemblies to produce radial loads in opposition to existing radial loads.

What is claimed is:

1. A turbopump assembly comprising:

a rotor defining an axis of rotation;

an impeller assembly supported on the rotor for rotation therewith;

a case structure adjacent to the impeller assembly and having one or more vanes extending therefrom; and a secondary flowpath for a fluid medium, the secondary flowpath defined between the impeller assembly and the case structure, wherein rotation of the impeller assembly generates a non-uniform circumferential pressure field in the secondary flowpath that produces radial loading on the rotor.

2. The turbopump assembly of claim 1, wherein the one or more vanes are configured to generate the non-uniform circumferential pressure field such that the radial load on the rotor is produced in a direction aligned with a preferred radial direction of movement of the rotor.

3. The turbopump assembly of claim 1, wherein one of the vanes is substantially rectangularly shaped.

4. The turbopump assembly of claim 1, wherein the one or more vanes are arranged within a first region of the case structure, and wherein the one or more vanes are substantially equally circumferentially spaced within the first region.

5. The turbopump assembly of claim 4, wherein the first angular region has an angular sweep of less than 180°.

6. The turbopump assembly of claim 4, wherein the first angular region has a total angular sweep of about 154°.

7. The turbopump assembly of claim 1 and further comprising:

a rotor bearing for supporting the rotor, wherein the radial loading on the rotor in turn causes radial loading of the rotor against the rotor bearing.

8. The turbopump assembly of claim 1, wherein the non-uniform circumferential pressure field in the secondary flowpath produces a substantially axial load on the rotor at a location radially spaced from the axis of rotation to produce a net moment.

9. A method of modifying a turbopump assembly to reduce vibrations, the turbopump assembly including a rotor defining an axis of rotation, an impeller subassembly and a static case, the method comprising:

identifying a preferred direction of movement of the rotor;

determining a non-uniform circumferential pressure field that can be formed in a secondary flowpath between the impeller subassembly and the static case to produce a radial load in the preferred direction of movement of the rotor; and forming vane structures that extend from the case in a pattern that facilitates generation of the non-uniform circumferential pressure field.

10. The method of claim 9, wherein the non-uniform circumferential pressure field is determined so as to produce a substantially axial load on the rotor at a location radially spaced from the axis of rotation to produce a net moment.

11. A fluid pump assembly comprising:

a rotatable component that can be rotated about an axis; and a static vane assembly located adjacent to the rotatable component, the static vane assembly comprising:

a circumferential surface axially spaced from the rotatable component, wherein the circumferential surface comprises a first angular region and a second angular region, the first and second angular regions defined substantially perpendicular to the axis of the rotatable component and having a combined angular sweep totaling 360°, and wherein an angular sweep of the first angular region is less than 180°; and a plurality of circumferentially spaced vanes extending from the circumferential surface toward the rotatable component, the plurality of vanes all located within the first angular region and configured to produce a radial load on the rotatable component when the rotatable component is rotating about the axis and a fluid is present between the static vane assembly and the rotatable component.

12. The fluid pump assembly of claim 11, wherein the rotatable component is an impeller assembly mounted on a rotor.

13. The fluid pump assembly of claim 12, wherein the plurality of vanes are configured to produce a radial load on the rotor in a first radial direction of movement of the rotor.

14. The fluid pump assembly of claim 1, wherein the plurality of circumferentially spaced vanes are substantially equally angularly spaced within the first angular region.

15. The fluid pump assembly of claim 1, wherein the static vane assembly comprises five vanes substantially equally angularly spaced with the first angular region.

16. The fluid pump assembly of claim 1, wherein one of the vanes is substantially rectangularly shaped.

17. The fluid pump assembly of claim 1, wherein the circumferential surface defines a case wall.

18. The fluid pump assembly of claim 1, wherein the first angular region has a total angular sweep of about 154°.

19. The fluid pump assembly of claim 1, wherein the plurality of vanes are configured to produce a produce a substantially axial load on the rotatable component at a location radially spaced from the axis to produce a net moment when the rotatable component is rotating about the axis and a fluid is present between the static vane assembly and the rotatable component.

* * * * *

UNITED STATES PATENT AND TRADEMARK OFFICE

CERTIFICATE OF CORRECTION

PATENT NO. : 7,670,110 B2
APPLICATION NO. : 11/485830
DATED : March 2, 2010
INVENTOR(S) : Scott R. Erler et al.

It is certified that error appears in the above-identified patent and that said Letters Patent is hereby corrected as shown below:

In Claim 14, Column 8, Line 31, delete "claim 1,", insert --claim 11,--

In Claim 15, Column 8, Line 34, delete "claim 1,", insert --claim 11,--

In Claim 16, Column 8, Line 37, delete "claim 1,", insert --claim 11,--

In Claim 17, Column 8, Line 39, delete "claim 1,", insert --claim 11,--

In Claim 18, Column 8, Line 41, delete "claim 1,", insert --claim 11,--

In Claim 19, Column 8, Line 43, delete "claim 1,", insert --claim 11,--

Signed and Sealed this

Eighth Day of June, 2010

David J. Kappos

David J. Kappos
*Director of the United States Patent and Trademark Office*